US005385141A

United States Patent [19]

Granatiero

[11] Patent Number: 5,385,141

[45] Date of Patent: Jan. 31, 1995

[54] SPEECH DIAPHRAGM AND EXHALATION VALVE

[75] Inventor: Nino M. Granatiero, Warwick, R.I.

[73] Assignee: Siebe North, Inc., Charleston, S.C.

[21] Appl. No.: 869,802

[22] Filed: Apr. 16, 1992

[51] Int. Cl.[6] ..... A62B 18/02; A62B 18/10; A62B 9/02

[52] U.S. Cl. ..... 128/201.19; 128/201.28; 128/205.24; 128/207.12

[58] Field of Search ..... 128/201.19, 201.28, 128/205.24, 207.12; 137/908

[56] References Cited

U.S. PATENT DOCUMENTS

| | | | |
|---|---|---|---|
| 2,038,267 | 4/1936 | Bullard | 128/201.19 |
| 3,035,574 | 5/1962 | Lytle et al. | 128/201.19 |
| 3,109,425 | 11/1963 | Gongoll et al. | 128/201.19 |
| 3,348,537 | 10/1967 | Miller et al. | 128/201.19 |
| 3,995,627 | 12/1976 | O'Neill | 128/201.28 |
| 4,991,577 | 2/1991 | Shigematsu | 128/205.24 |

*Primary Examiner*—Kimberly L. Asher
*Attorney, Agent, or Firm*—Abelman, Frayne & Schwab

[57] ABSTRACT

A combined speech diaphragm and exhalation valve for a respirator is formed as a unitary sub-assembly whereby the speech diaphragm is movable in unison with the exhalation valve.

8 Claims, 2 Drawing Sheets

SPEECH DIAPHRAGM AND EXHALATION VALVE

FIELD OF THE INVENTION

This invention relates to a valve assembly for use in conjunction with a face piece of a mask, and which permits exhalation of the user's breath from the interior of the face piece.

BACKGROUND OF THE INVENTION

Respirators are well-known in which the face piece is provided with an exhalation valve, and also a speech diaphragm which is employed to enhance the transmission of speech through the face piece, such face pieces being fabricated from a compliant sound-deadening rubber-like material.

It is also known, for example, from Gongoll et al. U.S. Pat. No. 3,109,425 issued Nov. 5th, 1963 to provide such an exhalation valve and speech diaphragm in combination with each other as an integrated sub-assembly for attachment to the face piece. A similar disclosure is to be found in Lytle et al. U.S. Pat. No. 3,035,574 issued May 22, 1962, which also teaches an integrated sub-assembly of exhalation valve and speech diaphragm that permits maximization of the uninterrupted frontal surface of the face piece and minimization of the number of through ports that must be provided in the face piece in order to accommodate the required combination of inlet and outlet ports and a speech diaphragm.

SUMMARY OF THE INVENTION

It is an object of the present invention to provide a combination of an exhalation valve and a speech diaphragm that allows for a reduction in the number of ports that must be provided in the face piece, while at the same time permitting a reduction in the size of the sub-assembly, and this, accompanied by a remarkable improvement in the transmitted sound.

According to the present invention, the exhalation valve and the speech diaphragm are formed as an integrated sub-assembly of exhalation valve and speech diaphragm, the exhalation valve and the speech diaphragm being supported for movement in unison relative to the face piece, such that, during speech of the user, which of essence requires controlled exhalation by the user, not only are the sound waves transmitted directly through the speech diaphragm, but also, the speech diaphragm is caused to move in unison with the exhalation valve under the influence of the modulated air pressure of the air expelled by the user in speaking. In this way, a remarkable improvement in the volume and in the dynamics of the transmitted speech is obtained, without in any way affecting the functioning of the exhalation valve.

In a preferred embodiment of the invention, the speech diaphragm is positioned centrally of the exhalation valve, the speech diaphragm and exhalation valve being supported on a spider of light-weight material that is in turn supported on a post of light-weight material that is freely movable axially with respect to a main body of the valve, the post being biased in a valve closing direction by means of a spring.

Thus, upon exhalation by the user, the exhalation valve moves away from its associated valve seat in entirely the usual manner in order to permit the exhalation by the user. If the user, as commonly happens, is speaking during exhalation, then, not only are the sound waves transmitted through the light-weight speech diaphragm in the usual manner, with further pulsations of the exhaled air being present in the air flowing past the exhalation valve, but, in addition, the speech diaphragm is bodily moving in forwards and return directions under the influence of the expelled modulated air pressure, in the same manner as the cone of a loudspeaker employed in sound reinforcement. Thus, in spite of the muffling effect produced by the valve and the dampening effect produced by the speech diaphragm, a substantial improvement in the quality of the transmitted sound is provided by the bodily movement of the speech diaphragm in forwards and rearwards directions as compared with the dampened effect on the transmitted speech that is produced by a speech diaphragm that is fixed relative to the face piece.

The invention will now be described with reference to the accompanying drawings which illustrate preferred embodiments of the invention, and in which:

FIG. 1 is a transverse cross-section through a combined speech diaphragm and exhalation valve assembly for a respirator; and, FIG. 2 is a transverse cross-section through an alternative embodiment of combined speech diaphragm and valve exhalation assembly for a respirator.

DESCRIPTION OF THE PREFERRED EMBODIMENTS

The drawings illustrate preferred embodiments of the invention in basic form, the various structures discussed being capable of modification in design and positioning in order to accommodate specific requirements of the associated face piece.

Figure 1:
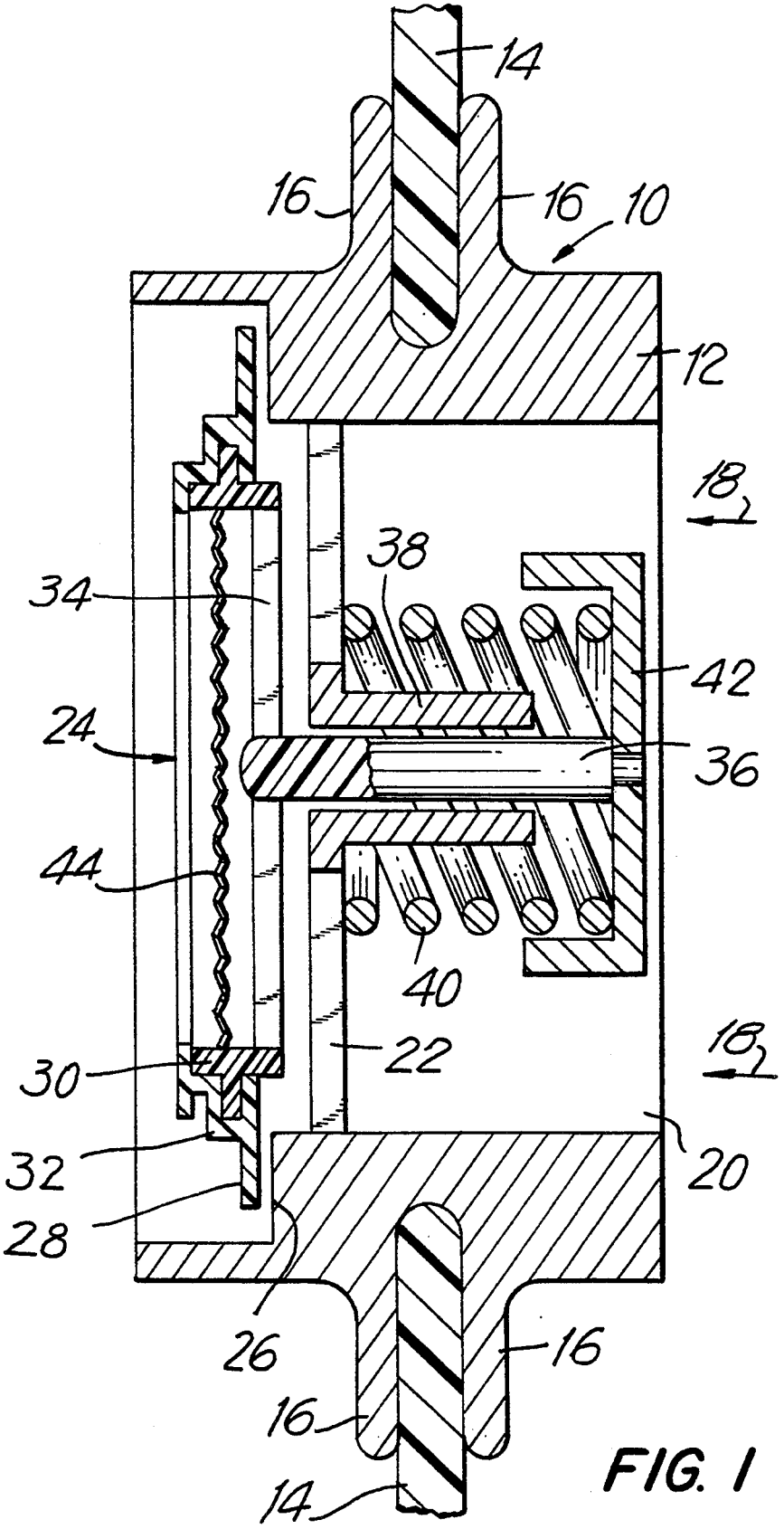

In FIG. 1, the combined exhalation valve assembly and speech diaphragm is shown generally at 10, the valve including a valve body 12 of circular configuration that is to be fitted in an aperture in a face piece 14, fragments of which are shown in the drawing to illustrate the manner of interconnection of the valve body 12 with the face piece 14. As illustrated, the valve body 12 is provided with annular flanges 16 that define an annular channel, into which a portion of the face piece can be fitted, the face piece then being stretched over one of the flanges 16 at the opposite diameter and inserted into the annular channel provided between the flanges 16. The face piece, which is formed of a rubber-like material, then contracts under its own inherent memory to firmly entrap the valve body 12 in the aperture in the face piece.

The direction of flow of exhaled air is indicated by the arrows 18, the exhaled air flow being through a central aperture 20 in the body 12 and through a spider 22, the exhaled air then passing to atmosphere past the combined speech diaphragm and exhalation valve, which is indicated generally at 24.

The valve body 12 provides a valve seat 26 for an annular valve member 28, the valve member 28 being formed from an elastomeric material.

The annular valve member 28 is carried on an annular support 30, the annular support 30 being formed from a hard plastics material, or optionally, from a light-weight metal. The valve member 28 is provided with flanges 32 that fit over the annular support member 30, thus to retain the valve member 28 in correct orientation with respect to the valve seat 26.

The annular support member 30 is supported on a spider 34, the spider 34 in turn being supported on a shaft 36 that is loosely supported for axial movement within a tubular extension 38 formed integrally with the spider 22.

Surrounding the tubular extension 38 is a coil spring 40, the coil spring 40 reacting between the spider 22 and an end cap 42 that is attached to the shaft 36 in any convenient manner, such as by being threaded onto the shaft 36. In the drawing, for convenience of illustration, the valve member 28 is shown as having been moved slightly off the valve seat 26, such as it would be in the condition where exhaled air is flowing through the central aperture 20 and past the spider 22. In the absence of such exhaled air, the valve member 28 will have been moved by the coil spring 40 into intimate seating relation with the valve seat 26.

Positioned within the annular support 30, and extending diametrically thereof is a speaking diaphragm 44, the speaking diaphragm being formed from any suitable impervious material, such as plastics sheeting or metal foil. Conveniently, the speaking diaphragm can be corrugated or otherwise formed to enhance its ability to move under the pressure of sound waves, such as is well-known in the art.

In the use of a respirator having a combined speech diaphragm and exhalation valve 10 according to the present invention, in the event that the pressure internally of the respirator is less than that determined by the force of the spring 40, the valve member 28 remains firmly and securely seated on the valve seat 26. In the event that the user of the respirator exhales, then, the air pressure existing internally of the central aperture 20 and acting against the back face of the speech diaphragm 44 and the valve member 28 will cause the assembly of speech diaphragm and exhalation valve 24 to move axially away from the valve seat 26, thus permitting exhaled air to pass between the valve seat 26 and the valve member 28 for it to be exhausted to atmosphere.

Figure 2:
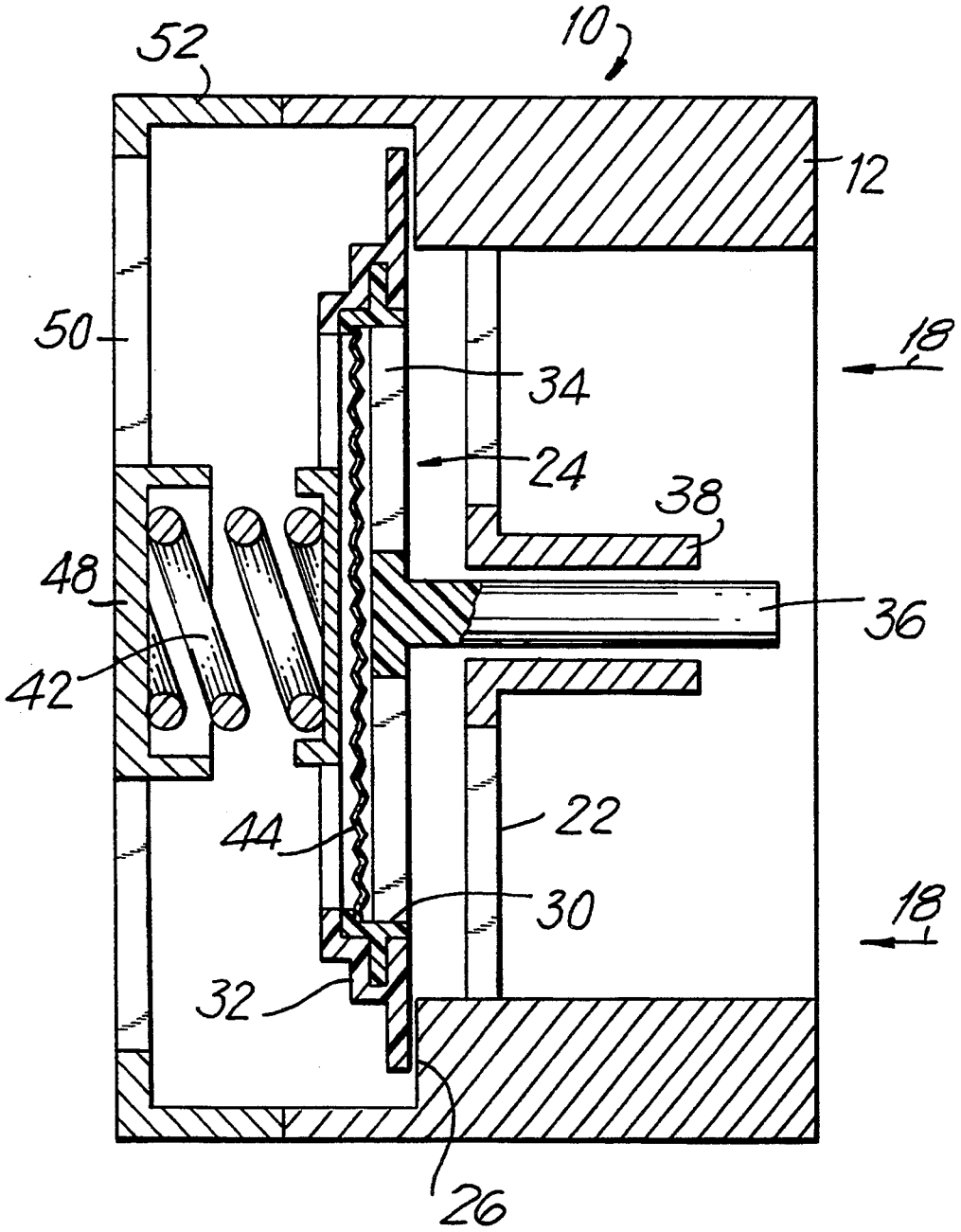

FIG. 2 illustrates an alternative embodiment of the invention, which incorporates the same floating speech diaphragm and valve assembly of FIG. 1, but, in which the restoring spring is differently positioned. In FIG. 2, the same reference numerals have been used for those members in common with FIG. 1.

In FIG. 2, the end cap 42 on the shaft 36 has been omitted, and, the coil spring 40 has been arranged frontally of the speech diaphragm and valve assembly 24, the coil spring 40 reacting against an abutment 48 carried by a spider 50 that forms part of a frontal cap 52 of the assembly.

As in FIG. 1, exhaled air exiting in the direction of the arrows 18 will cause the valve member 28 to lift off the valve seat 26 against the reaction of the coil spring 40, the speech diaphragm and valve assembly 24 at that time being held in floating relationship relative to the valve seat 26.

By this change in construction, the annular support 30, the spider 34 and the shaft 36 each can be formed of an extremely light-weight material, such as molded plastics, thus reducing the inertia of the combined speech diaphragm and valve assembly 24 under the influence of pulsating air pressure, such as occurs when the wearer of the respirator is speaking.

In the process of such exhalation by the wearer of the respirator, it will occur that the user speaks, thus resulting in pulsations in the pressure of the exiting exhaled air. In the absence of the speech diaphragm 44, as is common in respirators not requiring a speech diaphragm, the sound absorbative characteristics of the face piece 14, and, the impedance placed on the flow of exiting air past the valve member 28, will result in a muffled quality of the user's speech, and, a very considerable attenuation of the volume of the user's speech. In order to overcome this problem, it is common for such respirators to be provided with a speech diaphragm. So doing greatly improves the quality of the transmitted sound, but still results in a muffled quality and attenuation of the wearer's speaking voice, this being due to the fact that at the time the wearer of the respirator is speaking, the wearer of the respirator also is exhaling and the exhalation valve is open, thus effectively decoupling the speech diaphragm from the pulsating air pressure within the respirator resulting from the speech of the user. This is particularly so in the event that the speech diaphragm is positioned at a location other than in front of the user's mouth.

Combinations of exhalation valves and speech diaphragms are prior known in which the speech diaphragm is placed frontally of the mouth of the wearer of the respirator, in this way improving the transmission of the user's voice, and the intelligibility of the user's speech. However, those constructions also are encumbered with the problem that, at the time the user is speaking, the exhalation valve is in an opened condition, and, the air pressure within the respirator is only minimally above atmospheric. Thus, the efficiency of transmission of the wearer's speech through the speech diaphragm is greatly reduced, again resulting in a muffled and attenuated quality of the user's speech.

The combined speech diaphragm and exhalation valve of the present invention overcomes that problem in an extremely simple, but also highly effective manner, as is now discussed.

When using the combined speech diaphragm and exhalation valve of the present invention, at the time the user of the respirator commences to exhale and speak, the entire speech diaphragm and exhalation valve assembly 24 lifts off the valve seat 26, thus acoustically decoupling the speech diaphragm and exhalation valve from the body 12, the speech diaphragm and exhalation valve assembly 24 at that time floating on the force exerted by the coil spring 40. The coil spring 40, which can be a relatively weak spring, then permits the speech diaphragm and exhalation valve assembly 24 to move in the manner of a cone of a loudspeaker under the pulsating force of the air pressure resulting from the user's speech.

In this manner, in addition to the sound transmitted directly through the diaphragm 44, the diaphragm 44 is being bodily moved in axial directions, and is producing a wave front at the frontal surface of the speech diaphragm, that wave front being additive to the sound wave pressure being transmitted through the diaphragm.

The surprising result of this construction is that not only is less attenuation imposed on the volume of the speaker's transmitted voice, but also, the dynamics of the speaker's voice are greatly enhanced, thus making the speaker's voice considerably more intelligible externally of the respirator.

As will be appreciated, a basic structure of the combined speech diaphragm and exhalation valve of the present invention has so far been described. Numerous improvements are possible, including that of securing that end of the coil spring 40 adjacent the spider 22 directly to the spider 22 and securing the opposite end of the coil spring 40 directly to the cup-shaped member 42, the spring then acting to center the cup-shaped member 42 and the shaft 36 within the tubular extension 38, and out of touching engagement with the tubular extension 38. So doing will further improve the dynamics and volume of the speaker's voice over the situation that will occur in the event that the shaft 36 is in touching relationship with the tubular extension 38.

Optimally, the restoring force on the combined speech diaphragm and exhalation valve 24 is kept as low as is practicable, dependent on the requirement that sufficient restoring force must be applied to the combined speech diaphragm and exhalation valve 24 sufficient to secure proper seating of the annular valve member 28 on the valve seat 26.

It is also observed that the cup-shaped end cap 42 contributes significantly to the transmission of the dynamics of the user's voice, the cup-shaped end cap 42 providing a reaction surface for the pulsating air waves resulting from the user's speech, the cup-shaped end cap 42 itself being directly coupled to the diaphragm 44 by the shaft 36 and the spider 34, which acts as an armature to the annular support 30 to which the diaphragm 44 is affixed. This, again, is very much similar to the functioning of a loudspeaker, the cup-shaped end cap 42 approximating the voice coil of the loudspeaker and the diaphragm 44 approximating the cone of the loudspeaker, the spring 40 then acting in the manner of the conventional spider employed to center the cone of a loudspeaker and impose a restoring force on the speaker cone.

Various other modifications will occur to those skilled in the art, such modifications are included that fall within the scope of the appended claims.

What is claimed is:

1. A combined speech diaphragm and exhalation valve for a respirator mask, including:

a valve body having a central aperture providing an air passage communicating an inside of a respirator mask with an outside thereof;

a valve seat provided by said valve body;

a speech diaphragm, an exhalation valve, and a support member for said speech diaphragm and exhalation valve, said speech diaphragm, exhalation valve and support member forming a unitary sub-assembly;

means for supporting said sub-assembly for movement relative to said valve body and relative to said valve seat between a first position in which said exhalation valve is seated on said valve seat, and a second position in which said exhalation valve is spaced from said valve seat and exhaled air passes from said inside of a respirator mask to said outside thereof; and, resilient means for imposing a biasing force on said speech diaphragm, exhalation valve and support member sub-assembly and for moving said exhalation valve into seated relationship with said valve seat;

said speech diaphragm, exhalation valve, and support member forming said sub-assembly moving in unison against said biasing force responsive to pressure modulations in air under pressure exiting said valve body past said exhalation valve.

2. The combined speech diaphragm and exhalation valve of claim 1, in which said valve seat is an annular surface, said exhalation valve is an annular valve member, and, said speech diaphragm is positioned radially within said exhalation valve.

3. The combined speech diaphragm and exhalation valve of claim 1, in which said valve seat is an annular surface and said exhalation valve is an annular valve member, further including an annular member providing support for said exhalation valve at an inner periphery of said exhalation valve, and providing a support for said speech diaphragm at an outer periphery of said speech diaphragm.

4. The combined speech diaphragm and exhalation of claim 3, in which said speech diaphragm is a circular member hermetically sealed at an outer periphery thereof to said support member.

5. The combined speech diaphragm and exhalation valve of claim 3, in which said annular support member supports a shaft, a coil spring extends in surrounding relationship with said shaft, said shaft is supported by one end of said coil spring, the other end of said coil spring reacting against a member secured to with said valve body.

6. The combined speech diaphragm and exhalation valve of claim 5, in which said shaft extends concentrically within said coil spring.

7. The combined speech diaphragm and exhalation valve of claim 5, further including an end cap affixed to said shaft, said one end of said coil spring reacting against said end cap.

8. The combined speech diaphragm and exhalation valve of claim 7, in which said end cap is positioned internally of said valve body and within said aperture.

* * * * *